US005161604A

United States Patent [19]

Chandley et al.

[11] Patent Number: 5,161,604

[45] Date of Patent: Nov. 10, 1992

[54] DIFFERENTIAL PRESSURE, COUNTERGRAVITY CASTING WITH ALLOYANT REACTION CHAMBER

[75] Inventors: George D. Chandley, Amherst; Bryant W. Crocker, Peterborough, both of N.H.

[73] Assignee: General Motors Corporation, Detroit, Mich.

[21] Appl. No.: 857,757

[22] Filed: Mar. 26, 1992

[51] Int. Cl.[5] ..... B22D 18/06; B22D 27/00; B22D 27/20

[52] U.S. Cl. ..... 164/57.1; 164/58.1; 164/63; 164/255; 164/270.1

[58] Field of Search ..... 164/55.1, 56.1, 57.1, 164/58.1, 59.1, 63, 119, 255, 270.1, 306, 349, 363

[56] References Cited

U.S. PATENT DOCUMENTS

| | | | |
|---|---|---|---|
| 3,900,064 | 8/1975 | Chandley et al. . | |
| 3,971,433 | 7/1976 | Duchene | 164/362 |
| 4,340,108 | 7/1982 | Chandley et al. | 164/63 |
| 4,606,396 | 8/1986 | Chandley et al. | 164/255 |
| 4,874,029 | 10/1989 | Chandley | 164/34 |
| 4,957,153 | 9/1990 | Chandley | 164/7.1 |
| 4,977,946 | 12/1990 | Borrousch et al. | 164/57.1 |
| 4,989,662 | 2/1991 | Sabraw | 164/58.1 |
| 5,038,846 | 8/1991 | Doty | 164/58.1 |

FOREIGN PATENT DOCUMENTS

| | | | |
|---|---|---|---|
| 59-150654 | 8/1984 | Japan | 164/57.1 |

*Primary Examiner*—J. Reed Batten, Jr.
*Attorney, Agent, or Firm*—Edward J. Timmer

[57] ABSTRACT

A casting mold includes an ingate for engaging an underlying source of the melt, an upstanding alloyant-containing reaction chamber having an upper region communicated to the ingate, and an exit gate communicating a lower region of the reaction chamber to a mold cavity. The mold and the source of a melt are relatively moved to engage the ingate and the source. A sufficient relative vacuum is applied to the mold cavity to draw the melt from the source upwardly through the ingate and into the reaction chamber where the melt reacts with alloyant therein. The melt is drawn upwardly to leave at least a portion of the volume of the mold cavity unfilled with melt and to provide a sufficient volume of melt in the reaction chamber to fill the unfilled volume of the mold cavity after disengagement of the mold and the source. The mold and the source are then relatively moved to disengage the ingate and the source while a relative vacuum is applied to the mold cavity sufficient to draw the volume of melt in the reaction chamber into the mold cavity such that the unfilled volume thereof is filled after the mold and the source are disengaged. The reaction chamber is thereby essentially emptied of melt as required to fill the unfilled volume of the mold cavity. The melt in the ingate is drained back to the underlying source when the mold and the source are disengaged.

9 Claims, 3 Drawing Sheets

DIFFERENTIAL PRESSURE, COUNTERGRAVITY CASTING WITH ALLOYANT REACTION CHAMBER

FIELD OF THE INVENTION

This invention relates to an improved apparatus and method for the differential pressure, countergravity casting of a melt in a manner to effectively introduce alloyant into the melt in a reaction chamber in the mold while reducing the gating weight needed to make the casting.

BACKGROUND OF THE INVENTION

A vacuum-assisted, countergravity casting process using a gas permeable mold sealingly received in a vacuum housing is described in such patents as the Chandley et al U.S. Pat. Nos. 3,900,064; 4,340,108 and 4,606,396. That countergravity casting process involves providing a mold having a porous, gas permeable cope and a lower drag sealingly engaged at a parting plane, sealing the mouth of a vacuum housing to a surface of the mold such that a vacuum chamber formed in the housing confronts the gas permeable cope, submerging the underside of the drag in an underlying melt pool and evacuating the vacuum chamber sufficiently to draw the melt upwardly through one or more narrow ingates (pin gates) in the drag and into one or more mold cavities formed between the cope and the drag.

In practicing the vacuum-assisted, countergravity process to produce nodular iron castings, the melt is typically prepared in a melting vessel (e.g., a cupola) using a charge of pig iron to which additions of alloyants are made to provide the desired base melt chemistry. For example, in casting nodular iron, ferrosilicon (Fe-Si), ferromanganese (Fe-Mn) and other additions are made to the base pig iron charge to provide a desired base melt chemistry.

Once the desired base melt composition is achieved, the melt is transferred to a ladle where a nodularizing agent (e.g., a magnesium-bearing alloy such as Fe-Si-Mg) is added to spherodize (nodularize) the carbon in the melt. The treated base melt is then transferred from the ladle to a casting vessel to provide the melt pool from which a plurality of molds are successively vacuum-assisted, countergravity cast over time.

However, prior workers have experienced great difficulty in maintaining an effective concentration of magnesium in the melt over the extended time required to cast a plurality of molds in succession from the pool. This difficulty is attributable to the rapid evaporation of magnesium from the melt after the initial treatment with the nodularizing agent in the ladle. Erratic, uncontrolled loss (also known as fade) of the fugitive magnesium from the melt over time has been experienced and resulted in off-chemistry melts in so far as magnesium content is concerned and correspondingly inconsistent nodularization.

In the gravity casting of nodular iron, the mold has been provided with a reaction chamber and appropriate gating between the reaction chamber and the mold cavity to communicate them so as to fill the mold cavity with melt treated in the reaction chamber, e.g., as shown in the Duchenne U.S. Pat. No. 3,971,433. An appropriate quantity of nodularizing agent usually in particulate form is placed in the bottom of the reaction chamber so that the melt poured into the mold flows through the reaction chamber where it contacts the particulates in a manner to introduce the nodularizing agent therein to a sufficient extent to spherodize the carbon. This process is referred to in the casting art as the "in-mold" process.

This "in-mold" process has been applied to the vacuum-assisted, countergravity casting of nodular iron in that a reaction chamber has been formed in the countergravity casting mold beneath the mold cavity and a nodularizing agent in particulate form is placed in the bottom of the reaction chamber. The melt is drawn by a relative vacuum applied to the mold cavity to flow through the reaction chamber and then into the mold cavity from an underlying melt pool when a drag portion of the mold is immersed in the melt pool. The nodularizing agent is dissolved by contact with the melt in the reaction chamber and is thereby introduced into the melt to a sufficient extent to spherodize the carbon therein.

As applied to the gravity casting and vacuum-assisted, countergravity casting of nodular iron, the "in-mold" process is disadvantageous in that the metal gating weight of the resultant casting is increased as a result of solidified melt remaining in the reaction chamber and in the mold ingating that supplies melt to the mold cavity. Moreover, in countergravity casting thin-walled castings, the mold cavities fill so quickly that the reaction between the melt and the nodularizing agent does not occur to an effective degree to form an acceptable metallurgical microstructure. In addition, since the reaction products (e.g., slag, etc.) tend to float in the melt, they can contaminate the melt as it is drawn upwardly into the mold cavities, thereby yielding corresponding contaminated castings.

It is an object of the present invention to provide an improved apparatus and method for the differential pressure, countergravity casting of a melt wherein the melt is treated (e.g., nodularized) in a reaction chamber in the mold and drawn from the reaction chamber into a mold cavity while the mold/melt are engaged to partially fill the mold cavity and then further melt needed to complete filling of the mold cavity is drawn from the reaction chamber after mold/melt disengagement in a manner that removes melt from the reaction chamber so as to thereby reduce or minimize the gating weight of the resultant casting.

It is another object of the present invention to provide an improved apparatus and method for the differential pressure, countergravity casting of a melt wherein the melt is treated (e.g., nodularized) in a reaction chamber in the mold and is drawn into the mold cavity in a manner that provides time for the desired reaction of the melt and alloyant in the reaction chamber.

It is still another object of the present invention to provide an improved apparatus and method for the differential pressure, countergravity casting of a melt wherein the melt is treated (e.g., nodularized) in a reaction chamber in the mold and drawn into the mold cavity in a manner that reduces contamination of the casting and the underlying melt source by reaction products that may be generated in the reaction chamber.

SUMMARY OF THE INVENTION

The present invention contemplates a method and apparatus for the differential pressure, countergravity casting of a melt wherein a casting mold includes a first gate (ingate) for engaging an underlying source of the melt, an upstanding, alloyant-containing reaction chamber having an upper region communicated to the first gate (ingate) and a lower region, and a second gate (exit gate) communicating the lower region of the reaction chamber to a mold cavity. The mold and the source are relatively moved by suitable means to engage the first gate and the source.

A sufficient relative vacuum is applied to the mold cavity to draw the melt from the source upwardly through the first gate (ingate) and into the reaction chamber where the melt reacts with alloyant therein. The melt is drawn through the second gate (exit gate) to leave at least a portion of the volume of the mold cavity unfilled with melt and to provide a sufficient volume of melt in the reaction chamber to fill the unfilled volume of the mold cavity after disengagement of the mold and the source.

The mold and the source are relatively moved by suitable means to disengage the first ingate and the source while a relative vacuum is applied to the mold cavity sufficient to draw the aforesaid volume of melt in the reaction chamber through the second gate into the mold cavity such that the unfilled volume thereof is filled after the mold and the source are disengaged. The volume of melt needed to fill the unfilled volume of the mold cavity is thereby removed from the reaction chamber, typically leaving it essentially empty of melt. Moreover, the melt in the first gate is drained back to the underlying source when the mold and the source are disengaged.

In one embodiment of the invention, alloyant is dispersed on a wall of the reaction chamber from a lowermost bottom end toward an upper end thereof. The second gate is smaller in cross-sectional area than the first gate and communicates with the lower region of the reaction chamber above the lowermost bottom end thereof such that the melt begins to fill the reaction chamber and contact the alloyant before it is drawn into the mold cavity.

In another embodiment of the invention, the alloyant comprises a nodularizing agent for use in casting an iron melt and spherodizing the carbon of the melt during the casting operation.

The present invention also contemplates an improved casting mold for vacuum-assisted, countergravity casting of a melt wherein the mold includes a first gate (ingate) for engaging an underlying source of the melt, an upstanding, alloyant-containing reaction chamber having an upper region communicated to the first gate and lower region, and a second gate (exit gate) communicating the lower region of the reaction chamber to a mold cavity. The alloyant is dispersed on an upstanding wall of the reaction chamber in the lower region and at least a portion of the upper region for contact by the melt filling the reaction chamber. Preferably, the second gate is smaller in cross-sectional area than the first gate and communicates with the lower region of the reaction chamber above a lowermost bottom end such that the melt begins to fill the reaction chamber and contact the alloyant before the melt is drawn into the mold cavity through the second ingate.

DESCRIPTION OF THE DRAWINGS

FIG. 1 is taken along lines 1—1 of FIG. 3.

DETAILED DESCRIPTION OF THE INVENTION

Figure 1:
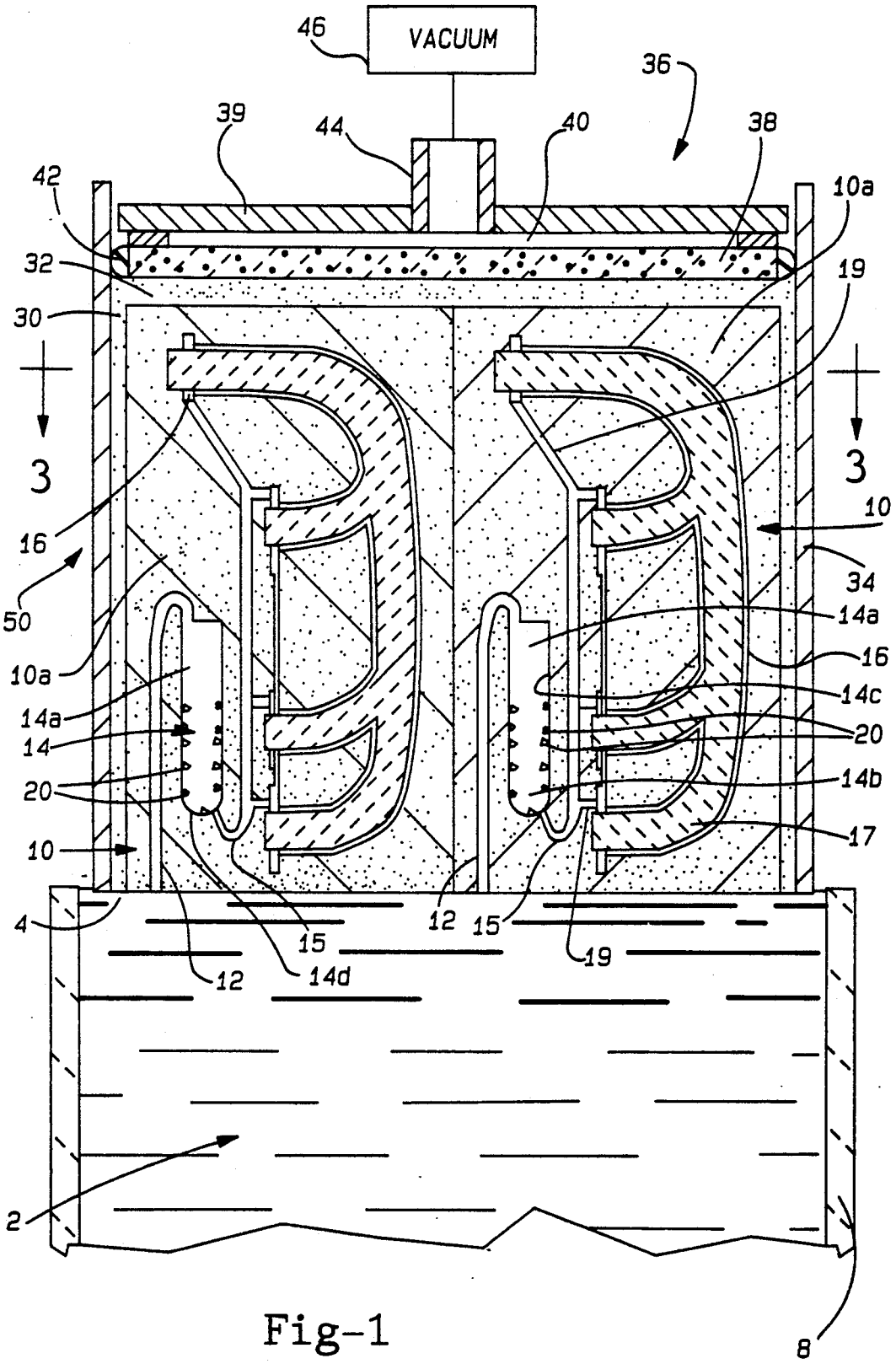
FIG. 1 is a sectioned, side view of a vacuum-assisted, countergravity casting apparatus in accordance with one embodiment of the invention with the mold ingates and the melt pool shown engaged before the mold cavities are filled with melt.
Figure 3:
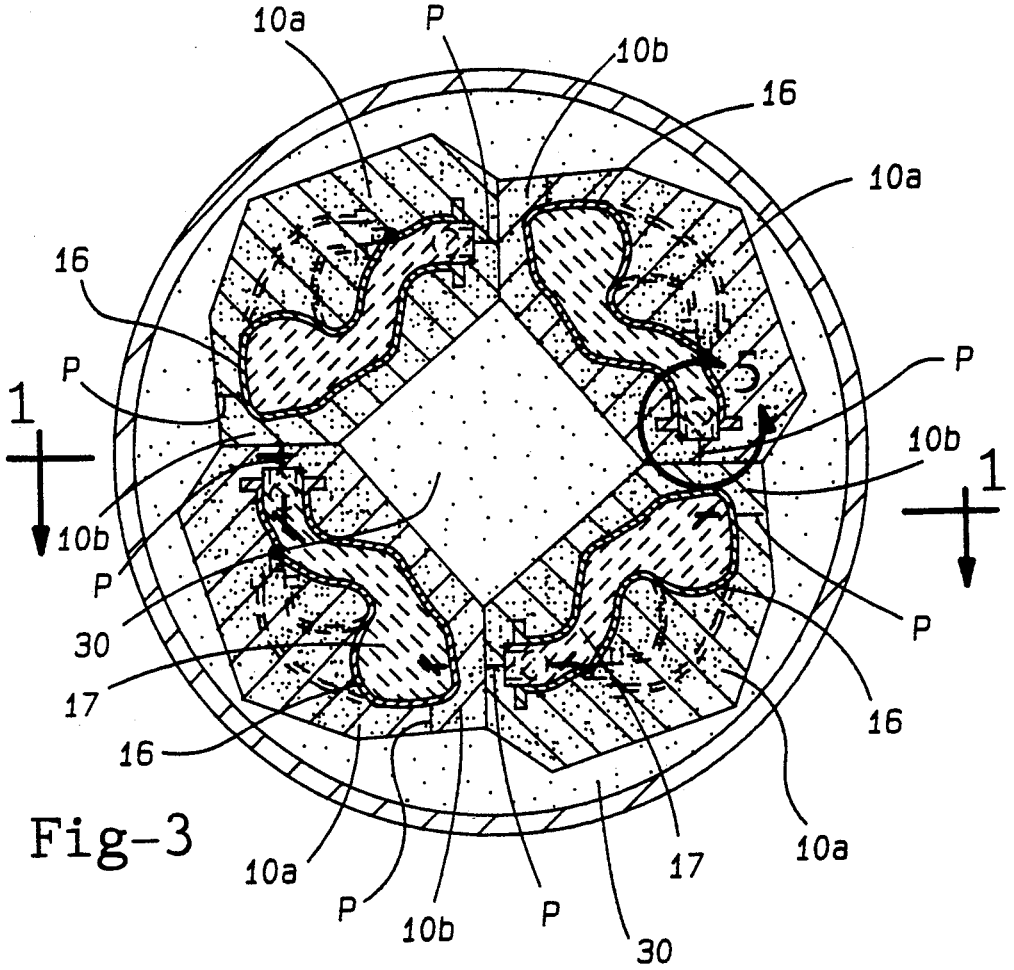
FIG. 3 is a sectional view of the apparatus taken along lines 3—3 of FIG. 1.

FIG. 1 depicts a pool 2 of melt 4 (e.g., molten iron) which is to be drawn up into each of a plurality of gas permeable casting molds 10 (four shown in FIG. 3). The melt 4 is contained in a casting furnace or vessel 8 heated by one or more induction coils (not shown) to maintain a desired melt casting temperature (e.g., about 2650° to about 2750° F. for molten iron).

Figure 2:
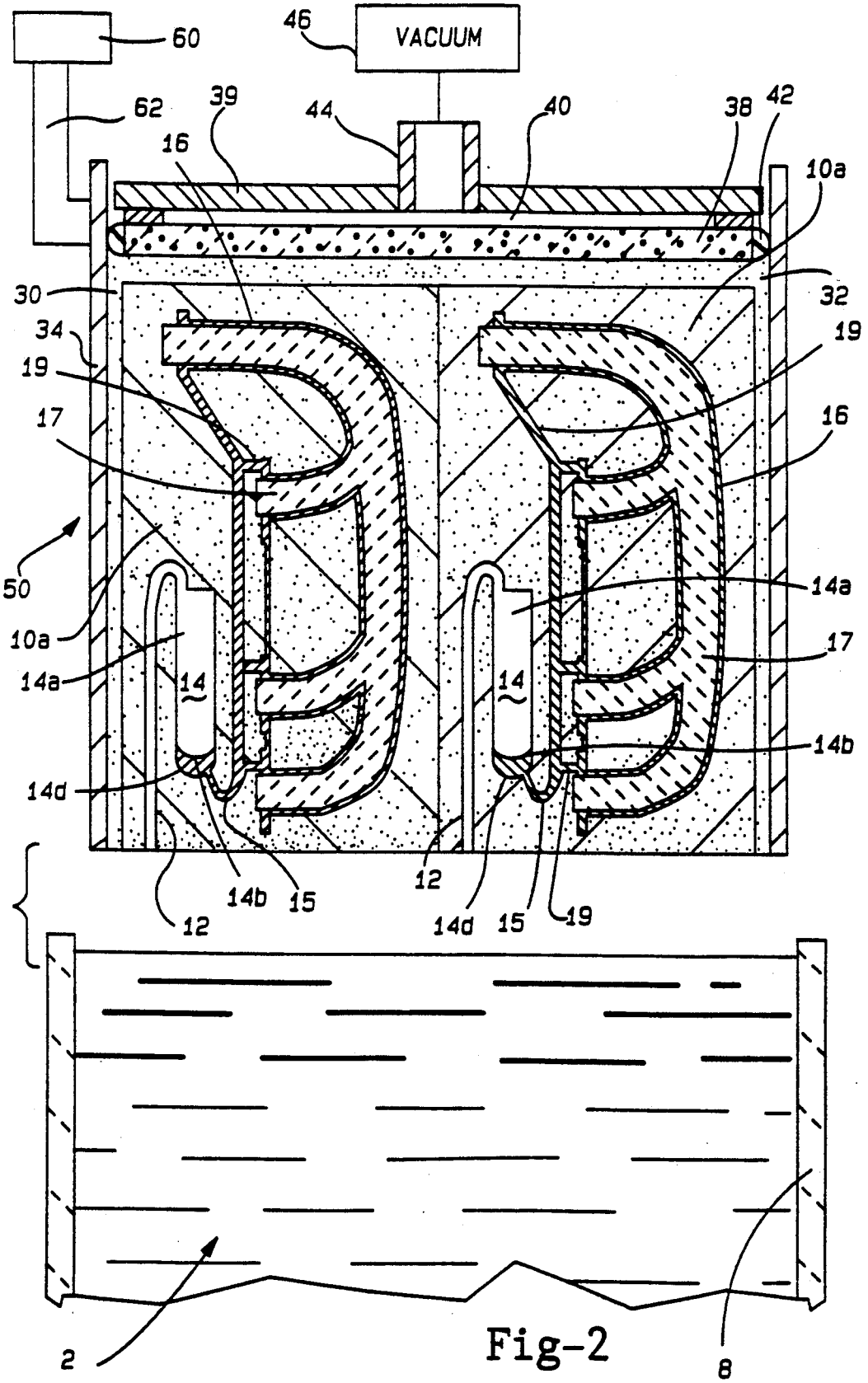
FIG. 2 is a sectioned, side view similar to FIG. 1 with the mold ingates and the melt pool shown disengaged after the mold cavities are filled with melt.

As shown best in FIG. 3, each gas permeable casting mold 10 comprises first and second mold sections 10*a*,10*b* formed of bonded refractory particulate (e.g., resin bonded foundry sand) and adhered or otherwise joined together at a vertical parting plane P therebetween. In FIGS. 1 and 2, each mold 10 includes a first gate (ingate) 12 for engaging the pool 2 or other source of the melt 4, an upstanding, alloyant-containing reaction chamber 14 having an upper region 14*a* communicated to the first ingate 12, and a second gate (exit gate) 15 communicating a lower region 14*b* of the reaction chamber 14 to a mold cavity 16 having a bonded refractory particulate (e.g., resin bonded foundry sand) core 17 therein. The mold cavity/core are illustrated as forming an internal combustion engine exhaust manifold-shaped cavity. The exit gate 15 is communicated to the mold cavity 16 via runners 19.

The reaction chamber 14 is illustrated as having an upstanding, cylindrical wall 14*c* terminating in a hemispherical, lowermost bottom end wall 14*d*.

Alloyant 20 is shown dispersed on the bottom end wall 14*d* of the lower region 14*b* and at least a portion of the upstanding wall 14C of the upper region 14*a* of the reaction chamber 14 for contact by the melt 4 filling the reaction chamber during the casting operation. Preferably, the alloyant 20 is in the form of particulates dispersed on the wall 14*c* and bottom end wall 14*d*. The particulate form of the alloyant is preferred to provide a high alloyant surface area for contact with the melt. However, the invention is not so limited, and other forms or shapes of the alloyant may be used in practicing the invention. The particulates of the alloyant 20 are typically stuccoed to the wall 14*c* and bottom end wall 14*d* by mold coatings well known in the art before the mold sections 10*a*,10*b* of each mold 10 are adhered or otherwise joined together at the parting plane P. A particular mold coating used to stucco the alloyant particulates on walls 14*c*,14*d* comprises zircon flour with a colloidal silica binder.

In making nodular iron castings in accordance with one embodiment of the invention, the alloyant 20 comprises a carbon nodularizing or spherodizing agent, such as, for example, iron-silicon-magnesium particulates (nominal composition of about 5 weight % Mg and balance equal amounts of Fe and Si) dispersed as particulates on the upstanding wall 14*c* and bottom end wall 14*d*. Such carbon nodularizing particulates typically have a size of about 6 to about 10 mesh. However, other known carbon nodularizing agents may be employed to countergravity cast nodular iron; e.g., Ni-Mg, Si-Ca-Mg, Si-Ce-Mg and the like also may be used. The quantity of the nodularizing agent is selected to effectively nodularize or spherodize the carbon in the melt 4 cast into each mold cavity 16. In this regard, a magnesium level of at least about 0.08 weight %, preferably about 0.09 to about 0.12 weight %, of the casting weight are employed. This results in 0.03–0.06 weight % Mg being present in each casting.

As shown in FIG. 1, the second gate 15 is smaller in dimension (e.g., diameter of 0.3 inch) or cross-sectional area (e.g., 0.7 $in^2$ cross-sectional area) than the first gate 12 (e.g., diameter of 0.5 inch and 0.25 $in^2$ cross-sectional area) and communicates with the lower region 14*b* of the reaction chamber 14 above the lowermost bottom end wall 14*d*. As a result of the location and difference in size of the gates 12,15 as well as the presence of the hemispherical bottom end wall 14*d*, the melt 4 initially filling the reaction chamber 14 will contact the alloyant 20 before being drawn into each mold cavity 16. In this way, drawing of untreated (e.g., unnodularized) melt 4 into each mold cavity 16 is substantially avoided. For purposes of illustration the reaction chamber wall 14*c* may have a height of about 8 inches and diameter of about 1.5 inches while the hemispherical wall 14*d* can have a diameter of about 1.5 inches for use with the specific gate dimensions/cross-sectional areas set forth above.

In preparation for the vacuum-assisted, countergravity casting of the melt 4, the molds 10 are disposed in a loose bed 30 of particulates 32 (e.g., loose foundry sand) in a vacuum box 34 as shown in FIG. 1 in accordance with Chandley U.S. Pat. No. 4,957,153, the teachings of which are incorporated herein by reference. The molds 10 are held in an annular array in the vacuum box by one or more peripheral straps (not shown) tightened therearound. A vacuum-applying member 36 is disposed in the upper end of the vacuum box 34 atop the loose particulates 32. The vacuum-applying member 36 comprises a lower gas permeable screen or ceramic member 38 and an upper housing 39 fastened (e.g., bolted) together so as to define a chamber 40 therebetween. An outer gas seal 42 is disposed on the gas permeable member 38 and effects a gas tight seal with the inner surface of the vacuum box 34. The chamber 40 is connected via a conduit 44 to a vacuum pump 46 or other means for establishing a relative vacuum in the chamber 40, and thus in the vacuum box 34 and the mold cavities 16 of the gas permeable molds 10 through the gas permeable member 38. The gas permeable member 38 is selected to have a gas permeability to this end while being impermeable to the loose particulates 32 in the vacuum box.

A sufficient relative vacuum is established in the chamber 40 to hold the molds 10 and the loose particulates 32 in the open-ended vacuum box 34 before, during and after casting (i.e., when the molds are filled with melt) in the manner described in the aforementioned Chandley U.S. Pat. No. 4,957,153. In effect, evacuation of the chamber 40 establishes a sufficient negative differential pressure between the inside and the outside of the box 34 to hold the molds 10 and the loose particulates 32 therein and prevent their falling out of the box 34. For example, a relative vacuum of 14 inches Hg in the chamber 40 can be used to hold molds 10 weighing about 30 pounds each filled with melt weighing about 50 pounds and loose sand weighing 150 about pounds in the vacuum box 34 having the following dimensions: 28 inches in diameter and 30 inches in height. For some alloys, it is desirable to place aluminum foil across the bottom of the bed of loose particulates 32 as taught in the Chandley U.S. Pat. No. 4,874,029. The foil is melted by the heat of the melt during mold immersion.

Moreover, evacuation of the chamber 40 (and thus the inside of the box 34) compacts the loose particulates 32 about the molds 10 by virtue of the atmospheric pressure applied to the lower side of the bed 30 and applied to the upper side of the bed 30 by the vacuum-applying member 36. The molds 10 are thereby supported by the bed 30 compacted therearound when the melt 4 is drawn into the mold cavities 16 during the casting operation.

Referring to FIG. 1, vacuum-assisted, countergravity casting of the melt 4 into the molds 10 held in the vacuum box 34 (molds 10, bed 30 and box 34 together referred to as casting assembly 50) is effected by relatively moving the casting assembly 50 and the pool to immerse (engage) the mold ingates 12 in the melt 4. Typically, the casting assembly 50 is lowered toward the pool 2 using a hydraulic power cylinder 60 (shown schematically in FIG. 2) actuating a movable support arm 62 (shown schematically) that is connected to the vacuum box 34. The relative vacuum established in the chamber 40 and thus in the inside of the box 34 is sufficient to draw the melt 4 upwardly through the ingates 12 and into the upper region 14*a* of the reaction chamber 14 for flow to the lower region 14*b*. As a result of the location and difference in size of the gates 12,15 as well as the presence of the hemispherical bottom end wall 14*d* of the reaction chamber 14, the melt 4 initially fills the lower region 14*d* of the reaction chamber 14 where it contacts the alloyant 20 dispersed on the wall 14*d* for reaction therewith before being drawn into each mold cavity 16. In this way, drawing of the untreated (e.g., unnodularized) melt 4 into each mold cavity 16 is substantially avoided. Moreover, the reaction chamber 14 quickly fills with additional melt 4 since the flow rate through the gate 12 to the reaction chamber is greater than the flow rate through the exit gate 15 out of the reaction chamber. Filling of the reaction chamber with the melt 4 in this manner allows adequate residence time of the melt in contact with the alloyant 20 dispersed on the walls 14*c*, 14*d* to effect the desired reaction (e.g., carbon nodularization if the alloyant 20 is a nodularizing agent and the melt 4 is molten iron). Any reaction products, such as slag, that are lighter (more buoyant) than the melt 4 will float to the upper region 14*a* of the reaction chamber 14. This separation of the reaction products in combination with the smaller cross-sectional size of the exit gate 15 enables discharge of clean melt out of the lower region 14*d* of the reaction chamber to the mold cavity 16 of each mold 10.

In accordance with the invention, the melt 4 is drawn upwardly from the pool 2 to an extent to leave at least a substantial portion of the volume of each mold cavity 16 unfilled with melt (e.g., 50% of the volume of each mold cavity, which mold cavity volume for purposes of illustration can be about 20 $inch^3$ per mold cavity) while, at the same time, drawing a sufficient volume of melt into each reaction chamber 14 to fill the unfilled volume of the associated mold cavity 16 after the pool 2 and the mold ingates 12 are disengaged. For purposes of illustration, the reaction chamber dimensions set forth hereinabove (providing a reaction chamber volume of about 14 inch$^3$) can be used to receive and store the volume of melt needed to fill the remaining mold cavity volume. In other words, the mold ingates 12 are immersed in the pool 2 only until the quantity of melt 4 in each mold cavity 16 and its associated reaction chamber 14 is adequate to subsequently fill each mold cavity upon pool/ingate disengagement. As a result, immersion time of the ingates 12 in the pool 2 is very short (e.g., 2 seconds). At that time, the pool 2 and the casting assembly 50 are relatively moved to disengage the ingates 12 and the melt pool 2 by, for example, raising the casting assembly 50 via the power cylinder 60 and the support arm 62.

Upon pool/ingate disengagement, the melt 4 residing in each mold ingate 12 drains back to the underlying pool 2 for reuse. The melt drained back to the pool 2 from the ingates 12 does not contaminate the pool with reaction products in the reaction chambers 14 since the melt in the ingates 12 does not reach the reaction chambers 14.

The relative vacuum established by vacuum pump 46 in chamber 40 and thus inside the vacuum box 34 is maintained during disengagement sufficient (e.g., about 14 inches Hg for the casting vacuum level set forth above) to draw a volume of melt 4 residing in each reaction chamber 14 into the associated mold cavity 16 to fill the unfilled volume thereof after pool/ingate disengagement. The relative vacuum is effective in this regard since relative pressure at the top of the mold cavities 16 is lower than the ambient pressure (atmospheric pressure) at the melt surface in reaction chambers 14. This filling of the each mold cavity 16 subsequent to disengagement leaves each reaction chamber 14 essentially empty, e.g., see FIG. 2, where a small amount of melt 4 remains in each reaction chamber 14. This emptying of the reaction chambers 14 and drainage of the melt from the ingates 12 upon pool/ingate disengagement substantially reduces melt usage in forming the castings in the mold cavities 16 and reduces the cost of forming the castings.

As a result, the present invention effectively treats (e.g., nodularizes) the melt 4 with the alloyant 20 while substantially reducing melt usage required for the gating. When the metal in the exit gates 15 is adequately solidified, the relative vacuum in chamber 40 can be released by communicating the chamber 40 to the ambient atmosphere using a suitable valve (not shown) on the vacuum-applying member 36. This permits separation of the melt-filled molds 10 and the loose particulate bed 30 from the vacuum box 34. For example, when the vacuum is released, the molds 10 and the bed 30 can fall by gravity from the vacuum box 34 onto a suitable shake-out grate (not shown).

Figure 4:
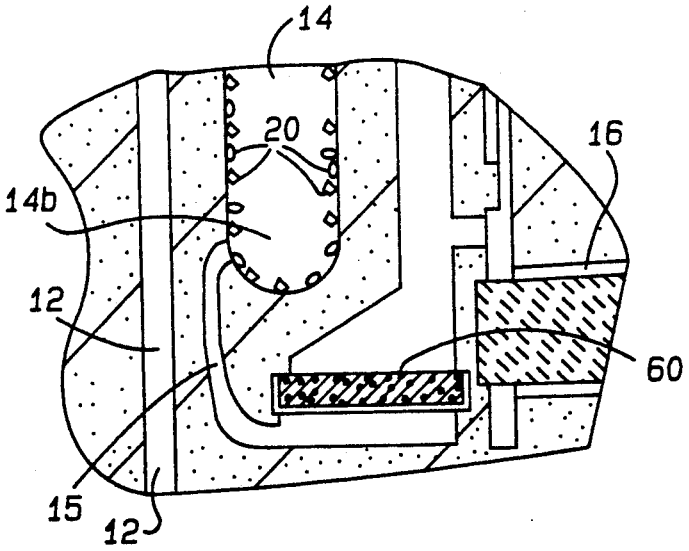
FIG. 4 is a partial sectioned, side view of an apparatus in accordance with another embodiment of the invention.
Figure 5:
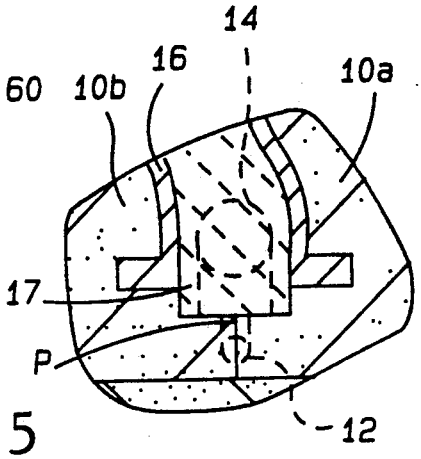
FIG. 5 is an enlarged sectional view of the apparatus of FIG. 3 in the region 5 of FIG. 3.

FIG. 4 illustrates another embodiment of the invention wherein a porous ceramic filter 60 is disposed in the exit gate 15 that extends from the lower region **14*b* of the reaction chamber 14 to the mold cavity 16. The ceramic filter 60 is selected to trap and remove any reaction products (e.g., slag) that may be drawn from the chamber 14 toward the mold cavity 16**.

The invention is not limited to practice using the molds 10 disposed in a loose particulate bed 30 as described hereinabove and can be practiced using other types of molds cooperatively associated with a vacuum box or housing; for example, as taught in the Chandley U.S. Pat. Nos. 3,900,064; 4,340,108, and 4,606,396. In using the apparatus/methods of these patents, a relative vacuum sufficient to draw the melt upwardly into each mold ingate/reaction chamber/mold cavity can be applied to the casting molds after their ingates are immersed in the melt pool 2 and maintained thereafter to fill the unfilled volume of each mold cavity with melt in the associated reaction chamber.

While the invention has been described in terms of specific embodiments thereof, it is not intended to be limited thereto but rather only to the extent set forth hereafter in the claims which follow.

We claim:

1. A method of differential pressure, countergravity casting of a melt, comprising the steps of:

a) providing a casting mold having a first gate for engaging an underlying source of the melt, an upstanding, alloyant-containing reaction chamber having an upper region communicated to the first ingate and a lower region, and a second gate communicating the lower region of the reaction chamber to a mold cavity, b) relatively moving the mold and the source to engage the first gate and the source, c) applying a sufficient relative vacuum to the mold cavity to draw the melt from the source upwardly through the first gate into the reaction chamber where the melt reacts with alloyant therein, said melt being drawn through the second gate to leave at least a portion of the volume of the mold cavity unfilled with melt and to provide a sufficient volume of melt in the reaction chamber to fill the unfilled volume of the mold cavity after said mold and said source are disengaged, and d) relatively moving the mold and the source to disengage the first gate and the source, and e) applying a relative vacuum to the mold cavity sufficient to draw said volume of melt in the reaction chamber through the second gate into the mold cavity to fill said unfilled volume thereof after said mold and said source are disengaged, whereby said volume of melt is removed from the reaction chamber.

2. The method of claim 1 including in step d), draining melt in the first gate to the underlying source.

3. The method of claim 1 wherein the alloyant is dispersed on a wall of the lower region and on at least a portion of a wall of said upper region.

4. The method of claim 3 wherein said second gate is smaller in cross-sectional area than said first gate and communicates with the lower region of said reaction chamber above a lowermost bottom end such that the melt begins to fill the reaction chamber and contact the alloyant before the melt is drawn into the mold cavity.

5. A method of differential pressure, countergravity casting of an iron melt, comprising the steps of:

a) providing a casting mold having a first gate for engaging an underlying source of the melt, an upstanding reaction chamber having an upper region communicated to the first gate and a lower region, a second gate communicating the lower region of the reaction chamber to a mold cavity, and a nodularizing agent dispersed in the reaction chamber from the lower region toward the upper region thereof, b) relatively moving the mold and the source to engage the first gate and the source, c) applying a sufficient relative vacuum to the mold cavity to draw the melt from the source upwardly through the first gate and into the reaction chamber where the melt reacts with the nodularizing agent to spherodize carbon therein, said melt being drawn through the second gate to leave at least a portion of the volume of the mold cavity unfilled with melt and to provide a sufficient volume of melt in the reaction chamber to fill the unfilled volume of the mold cavity after said mold and said source are disengaged, and d) relatively moving the mold and the source to disengage the first ingate and the source, and e) applying a relative vacuum to the mold cavity sufficient to draw said volume of melt in the reaction chamber through the second gate into the mold cavity to fill said unfilled volume thereof after said mold and said source are disengaged, whereby said volume of melt is removed from the reaction chamber.

6. Apparatus for the vacuum-assisted, countergravity casting of a melt, comprising:

a) a casting mold having a first gate for engaging an underlying source of the melt, an upstanding, alloyant-containing reaction chamber having an upper region communicated to the first gate and a lower region, and a second gate communicating the lower region of the reaction chamber to a mold cavity, b) means for relatively moving the mold and the source to engage the first gate and the source, c) means for applying a sufficient relative vacuum to the mold cavity to draw the melt from the source upwardly through the first gate and into the reaction chamber where the melt reacts with alloyant therein, said melt being drawn through the second gate to leave at least a portion of the volume of the mold cavity unfilled with melt and to provide a sufficient volume of melt in the reaction chamber to fill the unfilled volume of the mold cavity after said mold and said source are disengaged, d) means for relatively moving the mold and the source to disengage the first ingate and the source, and e) means for applying a relative vacuum to the mold cavity while said mold and said source are disengaged sufficient to draw said volume of melt in the reaction chamber through the second gate into the mold cavity to fill said unfilled volume thereof after said mold and said source are disengaged, whereby said volume of melt is removed from the reaction chamber.

7. The apparatus of claim 6 wherein the alloyant is dispersed on a wall of said lower region and on at least a portion of a wall of said upper region.

8. The apparatus of claim 7 wherein said second gate is smaller in cross-sectional area than said first gate and communicates with the lower region of said reaction chamber above a lowermost bottom end such that the melt begins to fill the reaction chamber and contact the alloyant before the melt is drawn into the mold cavity.

9. Apparatus for the vacuum-assisted, countergravity casting of an iron melt, comprising:

a) a casting mold having a first gate for engaging an underlying source of the melt, an upstanding reaction chamber having an upper region communicated to the first gate and a lower region, a second gate communicating the lower region of the reaction chamber to a mold cavity, and nodularizing agent dispersed from the lower region toward the upper region, b) means for relatively moving the mold and the source to engage the first gate and the source, c) means for applying a sufficient relative vacuum to the mold cavity to draw the melt from the source upwardly through the first gate and into the reaction chamber where the melt reacts with the nodularizing agent to spherodize carbon therein, said melt being drawn through the second gate to leave at least a portion of the volume of the mold cavity unfilled with melt and to provide a sufficient volume of melt in the reaction chamber to fill the unfilled volume of the mold cavity after said mold and said source are disengaged, d) means for relatively moving the mold and the source to disengage the first gate and the source, and e) means for applying a relative vacuum to the mold cavity while said mold and said source are disengaged sufficient to draw said volume of melt in the reaction chamber through the second gate into the mold cavity to fill said unfilled volume thereof after said mold and said source are disengaged, whereby said volume of melt is removed from the reaction chamber.

* * * * *